US010729251B2

(12) United States Patent
Lawson

(10) Patent No.: US 10,729,251 B2
(45) Date of Patent: Aug. 4, 2020

(54) LINKAGE MECHANISM FOR HI-LEG SEATING UNIT

(71) Applicant: L&P PROPERTY MANAGEMENT COMPANY, South Gate, CA (US)

(72) Inventor: Gregory Mark Lawson, Tupelo, MS (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 16/294,326

(22) Filed: Mar. 6, 2019

(65) Prior Publication Data

US 2019/0298070 A1 Oct. 3, 2019

Related U.S. Application Data

(63) Continuation of application No. 14/771,404, filed as application No. PCT/US2014/037686 on May 12, 2014, now Pat. No. 10,278,510.

(60) Provisional application No. 61/991,171, filed on May 9, 2014, provisional application No. 61/822,075, filed on May 10, 2013.

(51) Int. Cl.

| | |
|---|---|
| ***A47C 7/50*** | (2006.01) |
| ***A47C 1/0355*** | (2013.01) |
| ***A47C 1/034*** | (2006.01) |

(52) U.S. Cl.

CPC ..... *A47C 7/506* (2013.01); *A47C 1/0345* (2013.01); *A47C 1/0355* (2013.01)

(58) Field of Classification Search

CPC ..... A47C 7/506; A47C 1/0345; A47C 1/0355

USPC ..... 297/85 R

See application file for complete search history.

(56) References Cited

U.S. PATENT DOCUMENTS

| | | | |
|---|---|---|---|
| 4,662,673 | A | 5/1987 | Crum |
| 5,466,046 | A | 11/1995 | Komorowski et al. |
| 7,762,625 | B2 | 7/2010 | Hoffman et al. |
| 8,360,515 | B2 | 1/2013 | Crum |
| 2001/0048239 | A1 | 12/2001 | Kogure |
| 2003/0047973 | A1 | 3/2003 | Pellerin |
| 2010/0283297 | A1 | 11/2010 | Crum |
| 2011/0248535 | A1 | 10/2011 | LaPointe |
| 2011/0248546 | A1 | 10/2011 | LaPointe et al. |
| 2012/0146364 | A1 | 6/2012 | Hoffman et al. |
| 2012/0299363 | A1 | 11/2012 | Crum |
| 2015/0272329 | A1 | 10/2015 | Lawson |

FOREIGN PATENT DOCUMENTS

| | | | |
|---|---|---|---|
| CN | 101120842 | A | 2/2008 |
| CN | 201088308 | Y | 7/2008 |
| CN | 201175153 | Y | 1/2009 |

(Continued)

OTHER PUBLICATIONS

Extended search report dated Mar. 21, 2019 in European Patent Application No. 16856301.3, 5 pages.

(Continued)

*Primary Examiner* — Anthony D Barfield

(74) *Attorney, Agent, or Firm* — Shook, Hardy & Bacon LLP

(57) ABSTRACT

A linkage mechanism provides motion capabilities for various chair types. For example, a linkage mechanism includes a combination of links that facilitate ottoman extension/closing and backrest recline/incline. In addition a linkage mechanism includes a compact design that is usable with hi-leg style chairs having a relatively low seat height.

8 Claims, 12 Drawing Sheets

(56) References Cited

FOREIGN PATENT DOCUMENTS

| | | | |
|---|---|---|---|
| CN | 201208077 | Y | 3/2009 |
| CN | 201267314 | Y | 7/2009 |
| CN | 201447863 | U | 5/2010 |
| CN | 102065728 | A | 5/2011 |
| CN | 102160717 | A | 8/2011 |
| CN | 203563927 | U | 4/2014 |

OTHER PUBLICATIONS

Examiner's Report dated Oct. 22, 2019 in Canadian Patent Application No. 2,912,194, 4 pages.

LINKAGE MECHANISM FOR HI-LEG SEATING UNIT

CROSS REFERENCE TO RELATED APPLICATIONS

This Non-Provisional Patent Application is a continuation and claims priority to U.S. Non-Provisional patent application Ser. No. 14/771,404, filed on Aug. 28, 2015, and titled "LINKAGE MECHANISM FOR HI-LEG SEATING UNIT," which claims priority to PCT Application No. PCT/US2014/037686, filed on May 12, 2014, and titled "LINKAGE MECHANISM FOR HI-LEG SEATING UNIT," which claims priority to U.S. Provisional Application No. 61/991,171, filed on May 9, 2014 and titled "LINKAGE MECHANISM FOR HI-LEG SEATING UNIT," and U.S. Provisional Application No. 61/822,075, filed on May 10, 2013, and titled "LINKAGE MECHANISM FOR HI-LEG SEATING UNIT." This application is also related by subject matter to U.S. Pat. No. 9,844,269, issued on Dec. 19, 2017, and titled "LINKAGE MECHANISM FOR HI-LEG SEATING UNIT". The contents of these referenced applications are incorporated herein in their entirety.

BACKGROUND

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the present invention relates to an improved linkage mechanism developed to accommodate a wide variety of styling for a seating unit, which is otherwise limited by the configurations of linkage mechanisms in the field. Additionally, the improved linkage mechanism of the present invention provides for reclining a seating unit that includes a high-leg design and that includes a relatively low seat height.

Reclining seating units exist that allow a user to forwardly extend a footrest and to recline a backrest rearward relative to a seat. These existing seating units typically provide three basic positions (e.g., a standard, non-reclined closed position; an extended position; and a reclined position). In the closed position, the seat resides in a generally horizontal orientation and the backrest is disposed substantially upright. Additionally, if the seating unit includes one or more ottomans attached with a mechanical arrangement, the mechanical arrangement is collapsed such that the ottoman(s) are not extended. In the extended position, often referred to as a television ("TV") position, the ottoman(s) are extended forward of the seat, and the backrest remains sufficiently upright to permit comfortable television viewing by an occupant of the seating unit. In the reclined position the backrest is pivoted rearward from the extended position into an obtuse relationship with the seat for lounging or sleeping.

Several modern seating units in the industry are adapted to provide the adjustment capability described above. However, often the adjustment mechanisms used in these seating units are not ideal to be used with a high-leg chair design having a relatively low seat height.

SUMMARY

Generally, embodiments of the present invention seek to provide a simplified, compact linkage mechanism that can be adapted to essentially any type of seating unit, such as a high-leg style formal chair. In operation, the linkage mechanism is adapted to move between the closed position, the extended position, and the reclined position. Embodiments of the invention are defined by the claims below, not this summary. A high-level overview of various aspects of the invention are provided here for that reason, to provide an overview of the disclosure, and to introduce a selection of concepts that are further described below in the detailed-description section below. This summary is not intended to identify key features or essential features of the claimed subject matter, nor is it intended to be used as an aid in isolation to determine the scope of the claimed subject matter.

BRIEF DESCRIPTION OF THE DRAWINGS

Illustrative embodiments of the present invention are described in detail below with reference to the attached drawing figures, which are incorporated herein by reference, wherein.

DETAILED DESCRIPTION OF THE INVENTION

The subject matter of embodiments of the present invention is described with specificity herein to meet statutory requirements. But the description itself is not intended to necessarily limit the scope of claims. Rather, the claimed subject matter might be embodied in other ways to include different elements or combinations of elements similar to the ones described in this document, in conjunction with other present or future technologies.

Figure 1:
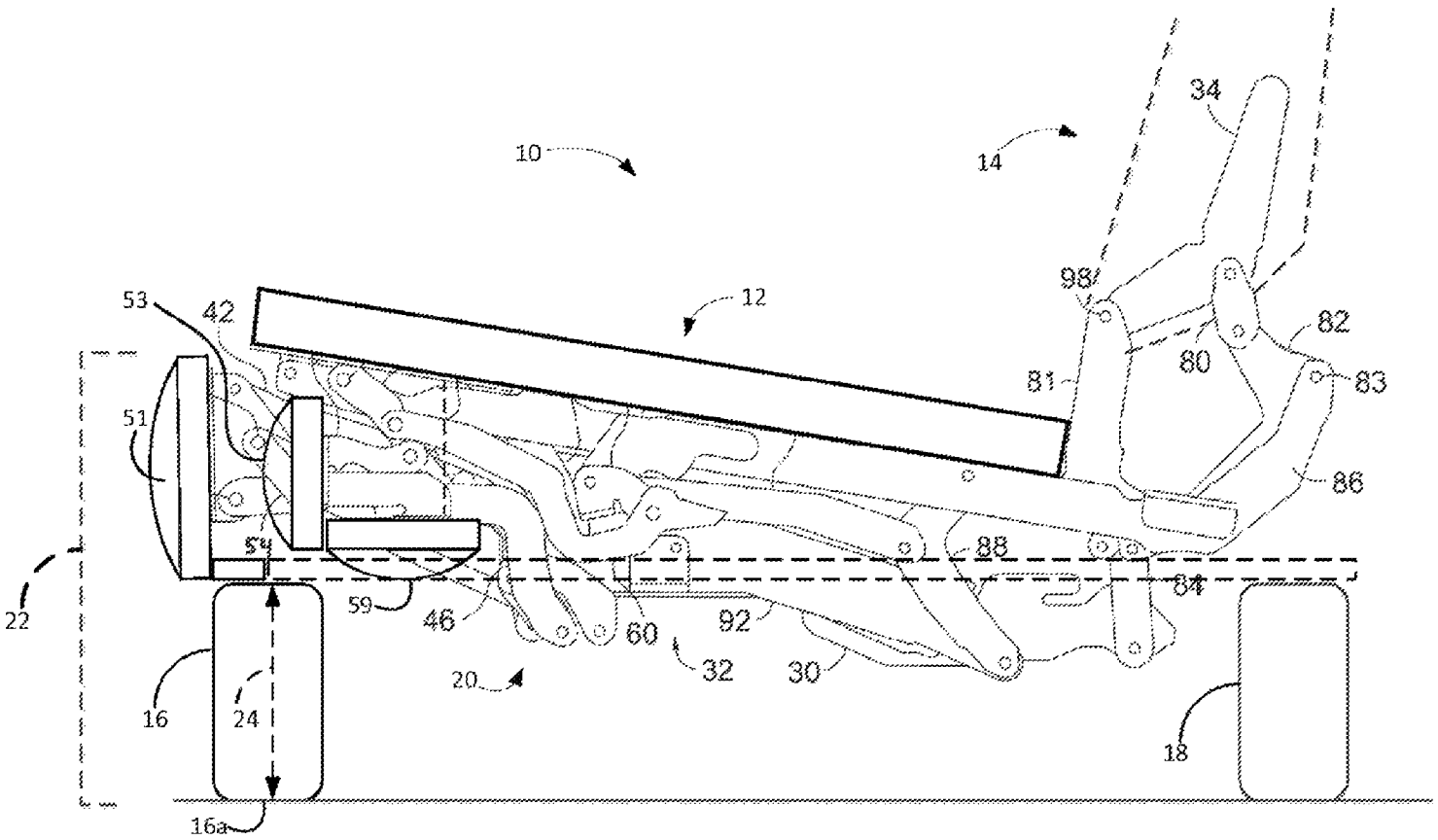
FIG. 1 depicts a side view of a linkage mechanism in a closed position and installed in a seating unit in accordance with an embodiment of the present invention.

Referring to FIG. 1, in accordance with an embodiment of the present invention, a seating unit 10 has a seat 12, a backrest 14, legs 16 and 18, and a linkage mechanism 20, which is positioned below the seat 12 and is shown in greater detail in FIGS. 2-4. In addition, the seating unit 10 might include one or more arms (not shown) and might be incorporated into a larger seating unit, such as a sofa or a modular seating unit.

In the context of a pivot-over-arm (POA) style chair, an arm would be interconnected with the seat and linkage mechanism 20, such that the legs 16 and 18 would not directly support the arm. The legs 16 and 18 support an underlying frame of the seating unit 10, such that the seat 12 is movable together with the arm. In a POA configuration the backrest 14 might include a wing portion that extends above the armrest and that pivots around the rear portion of the armrest when the backrest reclines. In an alternative configuration, known as a frame-within-a-frame style, the arm is stationary with respect to the seat 12, which is adjustable via the linkage mechanism. In this embodiment, the seat 12 is moveable during adjustment of the seating unit 10, but the arm remains relatively stationary.

In one embodiment, the backrest 14 extends from a rearward section of the seating unit 10 and is rotatably coupled to the linkage mechanism 20. In addition, as will be described in further detail with respect to FIGS. 2-4, the linkage mechanism 20 includes a footrest assembly, which extends and retracts one or more ottomans. In embodiments, the linkage mechanism 20 is arranged to articulably actuate and control movement of the seat 12, the backrest 14, and the ottomans between closed (collapsed) position, the extended position, and the reclined position.

In an embodiment of the present invention, the seating unit 10 includes a high-leg design having certain dimensional features. For example, FIG. 1 depicts a first dimension 22 including a distance between a portion of a seat mounting plate of the linkage mechanism 20 and a bottom end of a front leg 16 when the linkage mechanism 20 is in a closed or collapsed position. In one embodiment, the first dimension is in a range of about 11 inches to about 12.5 inches. FIG. 1 depicts a second dimension 24 including a height of the leg 16. In an embodiment of the invention, the second dimension 24 is in a range of about 5 inches to about 6 inches. Other dimensions of the present invention are described in other portions of this application, such as a distance between the seat mounting plate and a flipper ottoman bracket when the linkage mechanism is collapsed.

Absent the present invention, a high-leg chair that includes adjustment functionality of the present invention (e.g., footrest extension/collapse and backrest recline/incline) does not typically satisfy the first dimension 22 and the second dimension 24. For example, absent the present invention, it is challenging to have sufficient clearance above a ground surface to extend and collapse a footrest when the height of the seat mounting plate includes the first dimension. However, the present invention includes a linkage mechanism having a compact design, which allows for the seat mounting plate to be positioned low enough to satisfy the first dimension and for movement of the seating unit between the closed, extended, and reclined positions.

Figure 2:
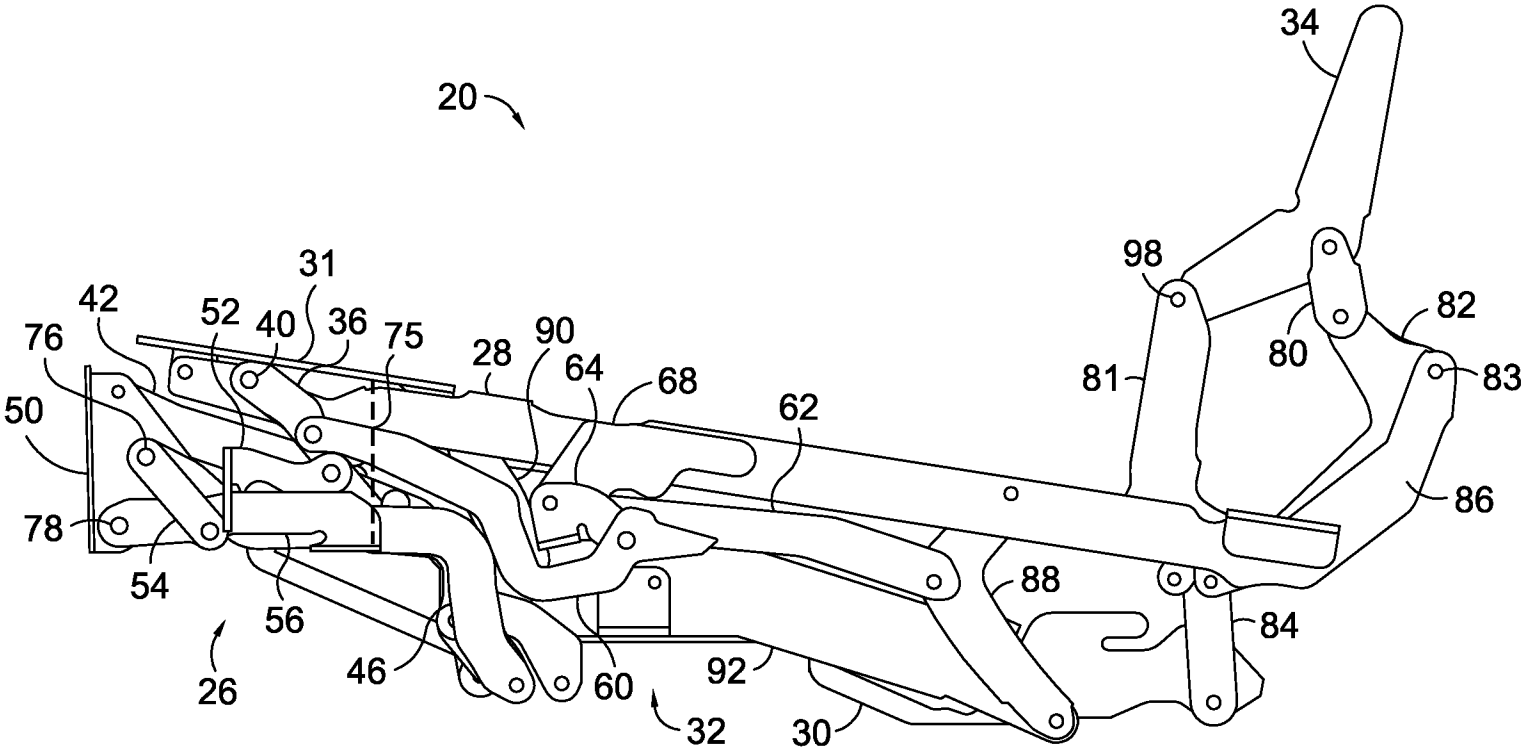
FIG. 2 depicts a side view of a linkage mechanism in a closed position in accordance with an embodiment of the present invention.
Figure 3:
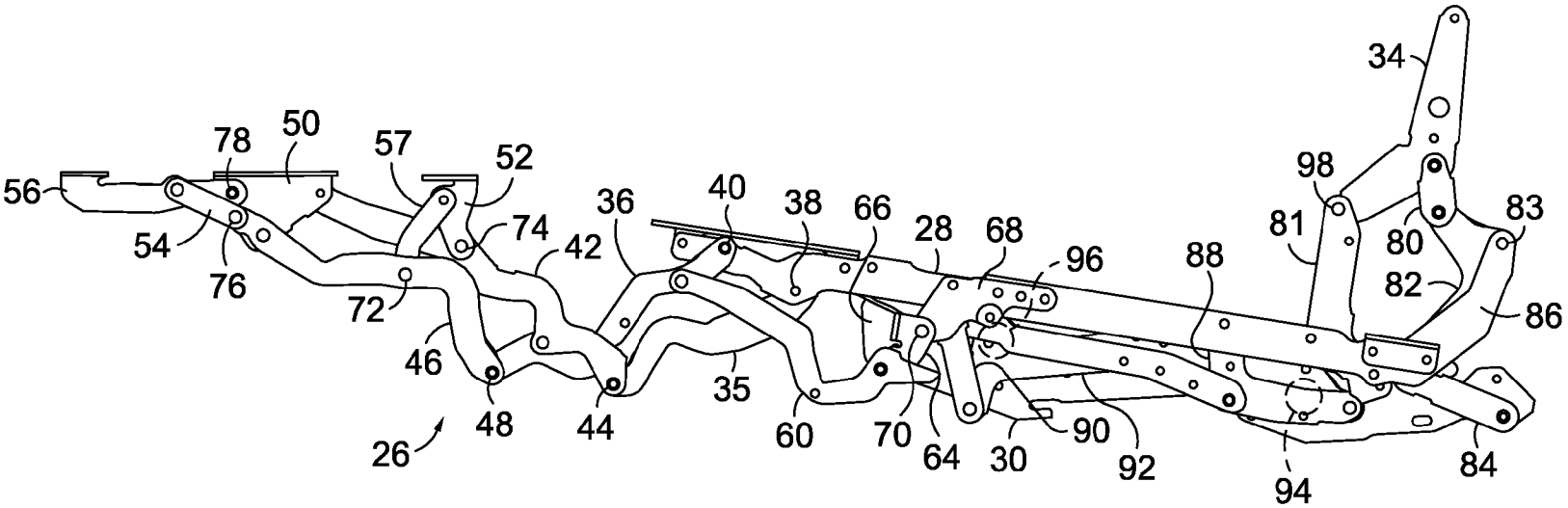
FIG. 3 depicts a side view of a linkage mechanism in an extended position in accordance with an embodiment of the present invention.
Figure 4:
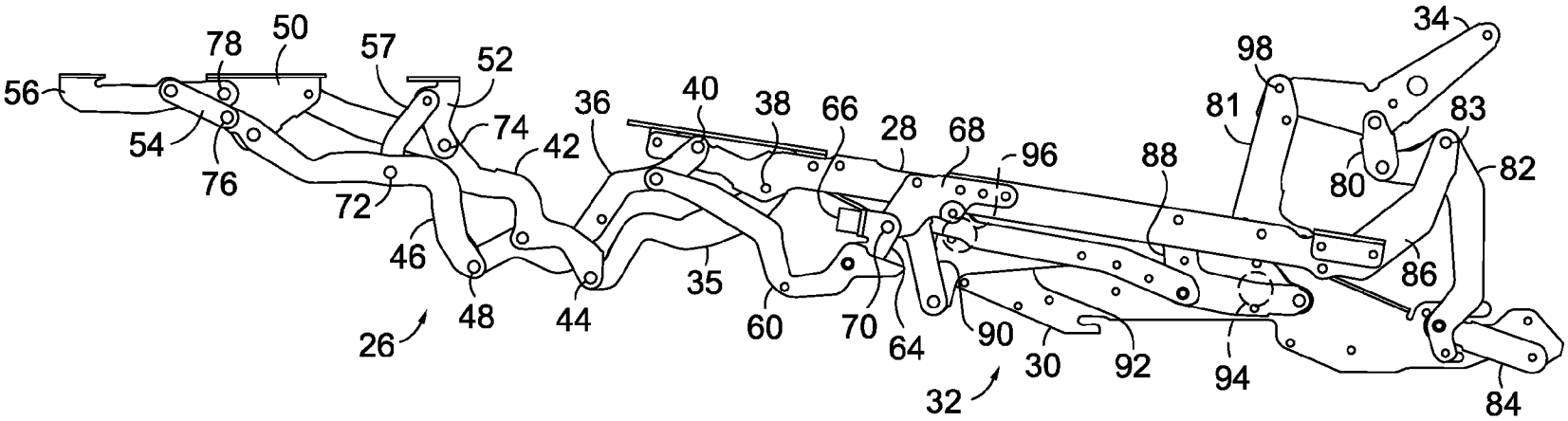
FIG. 4 depicts a side view of a linkage mechanism in a reclined position in accordance with an embodiment of the present invention.

FIGS. 2-4 illustrate a configuration of the linkage mechanism 20 for a manually or automatically adjustable, three-position recliner seating unit (hereinafter the "seating unit") that, in embodiments, is designed to be configured as to a high-leg style seating unit. As discussed above, the linkage mechanism 20 is arranged to articulably actuate and control movement of a seat, a backrest, and ottoman(s) of the seating unit. That is, the linkage mechanism 20 is adjustable to a closed position (FIG. 2), an extended (TV) position (FIG. 5), and a reclined position (FIG. 6). In the reclined position, as mentioned above, the backrest is rotated rearward and biased in a rearward inclination angle, which is an obtuse angle in relation to the seat.

During adjustment between the closed, extended, and reclined positions, the linkage mechanism 20 employs various links and pivots. The geometry of the links, as well as the locations of their interconnections, enable the advantages of a three-position, hi-leg seating unit having a relatively low seat height. Again, a relatively low seat height is defined, at least in part, by a first dimension 22 in which a distance between an end **16*a* of the leg 16 and the seat mounting plate is in a range of about 11 inches to about 12.5 inches. When this first dimension is satisfied, a finished seat height (i.e., including a seat cushion) of about 17 inches to about 18.5 inches is achievable with the linkage mechanism 20**.

Generally, the linkage mechanism 20 comprises a plurality of linkages that are arranged to actuate and control movement of the seating unit during movement between the closed, the extended, and the reclined positions. Typically, in order to accomplish articulated actuation of the linkage mechanism 20, the linkages may be pivotably coupled to one or more other linkages or plates comprising the linkage mechanism 20. It is understood and appreciated that the pivotable couplings (illustrated as pivot points in the figures) between these linkages can take a variety of configurations, such as pivot pins, bearings, traditional mounting hardware, rivets, bolt and nut combinations, or any other suitable fasteners which are well-known in the furniture-manufacturing industry. Further, the shapes of the linkages and the brackets may vary, as may the locations of certain pivot points. It will be understood that when a linkage is referred to as being pivotably "coupled" to, "interconnected" with, "attached" on, etc., another element (e.g., linkage, bracket, frame, and the like), it is contemplated that the linkage and elements may be in direct contact with each other, or other elements, such as intervening elements, may also be present.

In operation, the linkage mechanism 20 guides the rotational movement of the backrest, the seat, and the ottoman(s). In an exemplary configuration, these movements are controlled by a pair of essentially mirror-image linkage mechanisms (one of which is shown herein and indicated by reference numeral 20), which comprise an arrangement of pivotably interconnected linkages. The linkage mechanisms are disposed in opposing-facing relation about a longitudinally-extending plane that bisects the seating unit between the pair of opposed arms. As such, the ensuing discussion will focus on only one of the linkage mechanisms 20, with the content being equally applied to the other complimentary linkage assembly.

With reference to FIGS. 2-4, diagrammatic lateral views of the linkage mechanism 20, from a vantage point internal to the seating unit, are shown, in accordance with embodiments of the present invention. In one embodiment, the linkage mechanism 20 includes the footrest assembly 26, the seat-mounting plate 28, the base plate 30, and the seat-adjustment assembly 32. Footrest assembly 26 is comprised of a plurality of links arranged to extend and collapse the ottoman(s) during adjustment of the seating unit between the extended position and the closed position, respectively. Seat-mounting plate 28 is configured to fixedly mount to the seat and, in conjunction with an opposed seat-mounting plate, define a seat support surface (not shown). Seat-adjustment assembly 32 includes the back-mounting link 34 and a plurality of other links. Generally, the seat-adjustment assembly 32 is adapted to recline and incline the backrest, which is coupled to the back-mounting link 34. In addition, the seat-adjustment assembly 32 is adapted to laterally translate and angularly adjust the seat, which is coupled to the seat-mounting plate 28. Further, in automated embodiments of the seating unit, the seat-adjustment assembly 32 is coupled to crossbar(s) that are adjusted linearly or rotationally by a linear actuator (e.g., motor mechanism), thereby facilitating movement of the seating unit in response to user-initiated electronic actuation.

In embodiments, one or more legs 16 and 18 are adapted to vertically raise and support the seating unit above an underlying surface. In embodiments, the leg(s) are mounted to arms in the frame-within-a-frame style chair, while the leg(s) are mounted to an underlying arm base in the pivot-over-arm style chair. Sometimes, a chassis is mounted to either the arm or the underlying arm base. The base plate 30 is mounted to tube(s) (e.g., both front and rear) spanning the chassis. The seat-mounting plate 28 is interconnected to the base plate 30 via links comprising the seat-adjustment assembly 32, which translate the seat over the base plate 30 during adjustment between the closed, extended, and reclined positions while incrementally adjusting the angle of inclination therebetween.

With reference to FIGS. 2-4, the footrest assembly 26 will be described in greater detail. The footrest assembly 26 includes a rear ottoman link 35, and a front ottoman link 36, both of which attach to the seat mounting plate at pivots 38 and 40, respectively. The footrest assembly 26 further comprises a main ottoman link 42, which attaches to the rear ottoman link 35 at pivot 44 and a second ottoman link 46, which attaches to the front ottoman link 36 at pivot 48. The second ottoman link 46 and the main ottoman link 42 are both attached to the footrest bracket 50, and the main ottoman link 42 is also attached to the mid-ottoman bracket 52. The footrest bracket functions to support a footrest 51 (FIG. 1), and the mid-ottoman bracket functions 52 to support another ottoman 53 (FIG. 1) in addition the footrest 51. A mid-ottoman control link 57 is attached from the second ottoman link 46 to the mid-ottoman bracket 52. The footrest assembly 26 further comprises a flipper control link 54 that is attached to the second ottoman link 46 and to a flipper ottoman bracket 56, which is usable to support another footrest 59 (FIG. 1). In some aspects, the flipper ottoman bracket includes a footrest mounting surface for supporting a footrest, and wherein the linkage mechanism is movable between a closed position and an extended position.

As indicated above, the footrest assembly 26 functions to actuate and move the plurality of footrests 51, 53, and 59 from a closed or collapsed position (FIGS. 1 and 4) to an extended position (FIG. 3). As such, the linkage mechanism 20 further comprises a lock link 60, which is attached to the front ottoman link 36, and a footrest drive link 62, which is attached to the rear ottoman link 35. The lock link 60 is further attached to a lock bracket 64, which attaches to a drive tube 66 and a lock mounting plate 68. When the drive tube 66 is activated (either manually or using a motor), the lock bracket 64 is rotated clockwise (in the view provided by FIG. 2) around the pivot 70 attaching the lock bracket 64 to the lock mounting plate 68. This motion of the lock bracket 64 drives the lock link 60 forward, which in turn causes the front ottoman link 36 to rotate clockwise on pivot 40, which attaches the front ottoman link 36 to the seat plate 28. At the same time, drive link 62 and rear ottoman link 35 are activated, in which case rear ottoman link 35 rotates clockwise on pivot 38, which attaches the rear ottoman link 35 to the seat plate 28.

The clockwise rotation the rear ottoman link 35 and the front ottoman link 36 from the closed position of FIG. 2 in turn causes the main ottoman link 42 and the second ottoman link 46 to rotate counterclockwise as they extend to the extended configuration of FIG. 3. In addition, the mid-ottoman control link 57 and the mid-ottoman bracket 52 rotate clockwise on pivots 72 and 74, respectively to move from the closed position (FIG. 2) to the extended position (FIG. 3). Further, the flipper control link 54 and the flipper ottoman bracket 56 rotate clockwise on pivots 76 and 78, respectively, to move from the closed position (FIG. 2) to the open position (FIG. 3).

As indicated previously, the compact design of the linkage mechanism 20 allows for the footrest assembly 26 to move from the closed position to the extended position when the seating unit includes the first dimension 22 and the second dimension 24 (FIG. 1). The compact design is a function of the various geometries of the links included in the footrest assembly, such as the shape and spacing of linkages, lengths of linkages, distances between pivots, and the like. In one embedment, those features are as depicted in FIGS. 2-4.

The compact design of the linkage assembly 20 provides other benefits as well. For example, in one embodiment, the design allows a flipper-ottoman board (not shown) mounted to the flipper-ottoman bracket 56 to extend to the near width of the main-footrest board (not shown). Absent this technology, the flipper-ottoman board is reduced and is not able to extend as wide (from left to right). In another embodiment, the design satisfies a third dimension 75 defined by a distance between a seat mounting flange 31 and a mounting surface of the flipper-ottoman bracket 56 when the assembly is in a closed position. In one embodiment, the third dimension is about 3.625 inches.

Movement of the ottomans 51, 53, and 59 and the footrest assembly 26 from a closed arrangement to an extended position has been described. Collapsing or closing these elements is facilitated by moving the drive tube 66 in an opposite direction (i.e., counterclockwise direction in FIG. 3), which in turn causes a reverse of the above described movements.

With continued reference to FIGS. 2-4, the seat-adjustment assembly 32 will now be described in more detail. As indicated previously, the seat-adjustment assembly 32 attaches the seat plate 28 to the base plate 30. Also, the seat-adjustment assembly 32 traverses the seat plate 28 forward when the backrest 14 is moved into a more reclined position and traverses the seat plate 28 rearward as the backrest 14 is moved into a more inclined position.

The seat-adjustment assembly 32 includes a back drive link 80, rear bellcrank 82, and back toggle link 84. The back drive link 80 attaches to the back mounting bracket 34 and to the rear bellcrank 82. The mounting bracket 34 attaches to a rear seat bracket 81 extending from the seat mounting plate 28. The rear bellcrank 82 is attached at pivot 83 to a rear portion 86 of the seat mounting plate 28 and to the back toggle link 84, which attaches to the base plate 30.

The seat-adjustment assembly 32 further comprises a rear pivot link 88 and a front pivot link 90, both of which attach to a roller link 92. The roller link 92 includes two rollers 94 and 96, which are rotatably coupled to the roller link 92. The rollers 94 and 96 are positioned between the roller link 92 and the base plate 30 and the rollers 94 and 96 are positioned on one or more tracks of the base plate 30.

As previously indicated, the seat-adjustment assembly 32 facilitates recline and incline of the backrest 14 and traverses the seat mounting plat 28 with respect to the base plate 30. The operation of the seat-adjustment assembly 32 will now be described in more detail.

Referring to FIG. 3, the seat-mounting plate 28 has been adjusted downward as a result of moving from a closed position to an extended position. At least part of the downward shift results from the footrest drive link 62 acting on the rear pivot link. That is, when the linkage mechanism moves from a closed position to an extended position, the rear pivot link rotates counterclockwise, thereby shifting the seat mounting plate downward. Moving to the reclined position, the back-mounting bracket 34 is rotated clockwise on pivot 98, which attaches the back-mounting bracket 34 to the rear seat bracket 81. For example, back-mounting bracket 34 might be rotated clockwise when a user seated in the seating unit 10 leans backward or otherwise applies weight to the backrest 14. Rotation of the back mounting bracket 34 clockwise pushes the back drive link 80 downward, thereby causing the rear bellcrank 82 to rotate counterclockwise on pivot 83 and to shift downward. The back toggle link 84 adjusts counterclockwise on the pivot attaching the back toggle link 84 to the base plate 30. When the base plate 30 is fixed relative to the seat-mounting plate (such as when the base plate 30 is directly or indirectly attached to legs of a chair resting on the floor), the movement of the back mounting bracket 34, back drive link 80, rear bellcrank 82, and back toggle link 84 initiates a forward motion of the seat mounting plate 28.

With continued reference to FIG. 3, as the seat mounting plate 28 is biased forward, the rear pivot link 88 and front pivot link 90 transfer the forward motion of the seat mounting plate 28 to the roller link 92. In turn, the roller link 92 shifts forward relative to the base plate 30 using the rollers 94 and 96, which traverse the track of the base plate 30.

Movement of the seat-adjustment assembly 32 from a relatively inclined position in FIG. 3 to a relatively reclined position in FIG. 4 has been described. Movement from the position depicted in FIG. 4 to the position depicted in FIG. 3 is facilitated by rotating the back-mounting bracket 34 in a counterclockwise direction (as viewed in FIG. 3), which in turn causes a reverse of the above described movements. For example, the back-mounting bracket 34 might be actively moved and/or a force that moved the back-mounting bracket 34 clockwise (e.g., user's weight) might be removed. Likewise, a user leaning forward might also apply a force that allows the back mounting link 34 to rotate counterclockwise.

Figure 5:
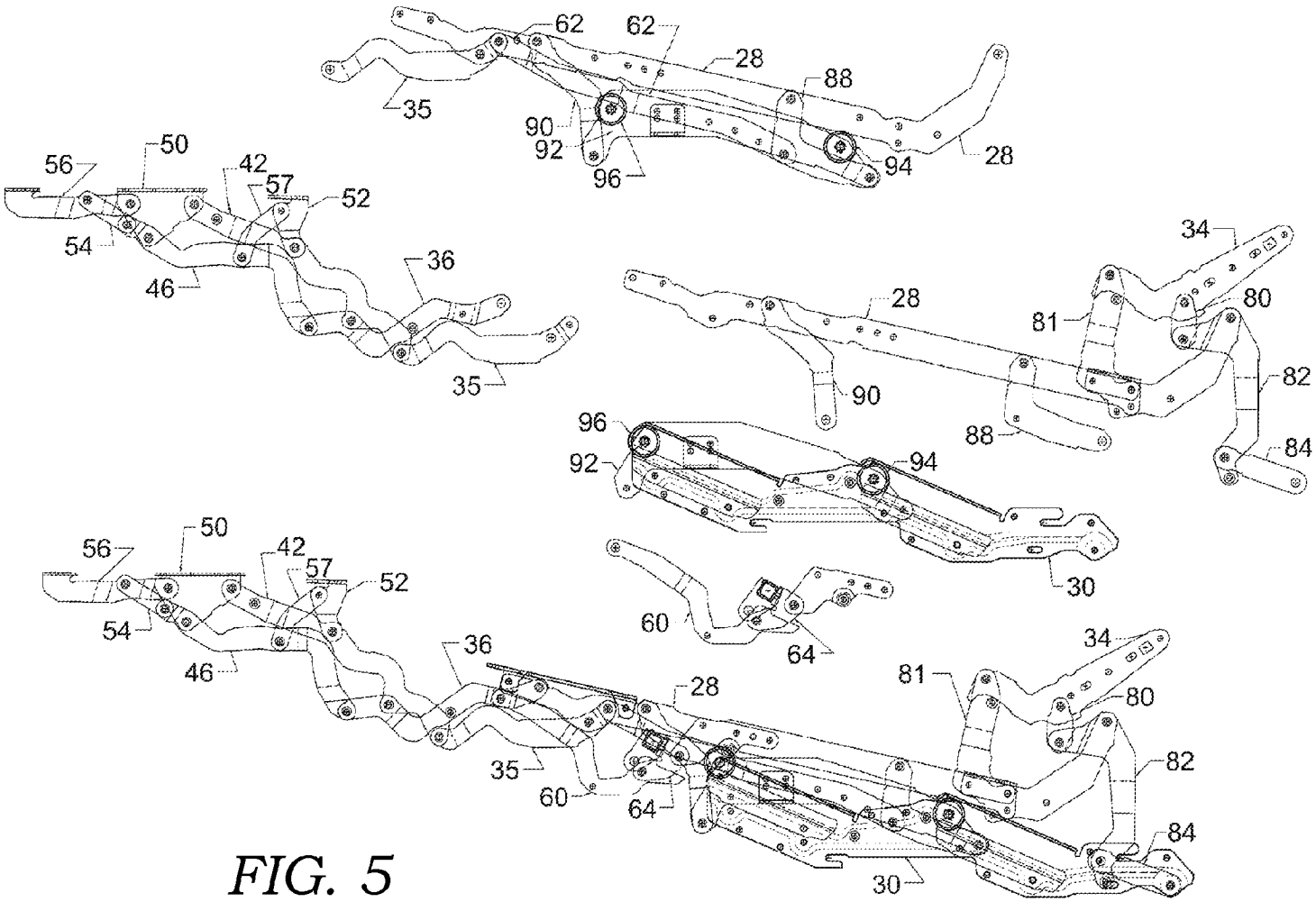
FIG. 5 depicts various views of different combinations of linkages, which are labeled, in accordance with an embodiment of the present invention.
Figure 6:
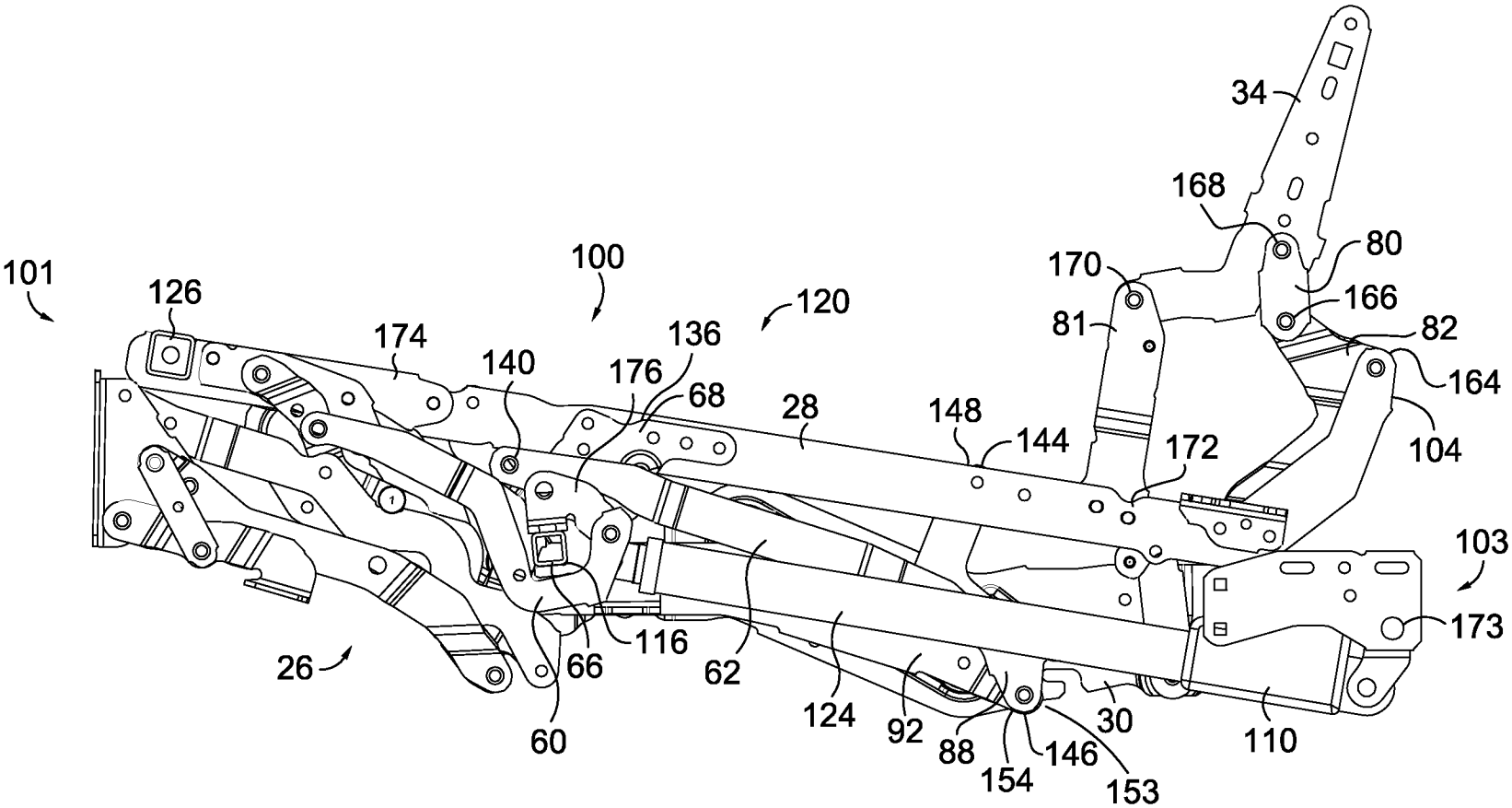
FIG. 6 depicts a side view of a motorized, adjustable linkage mechanism for a seating unit in a closed position, in accordance with an embodiment of the present invention.
Figure 7:
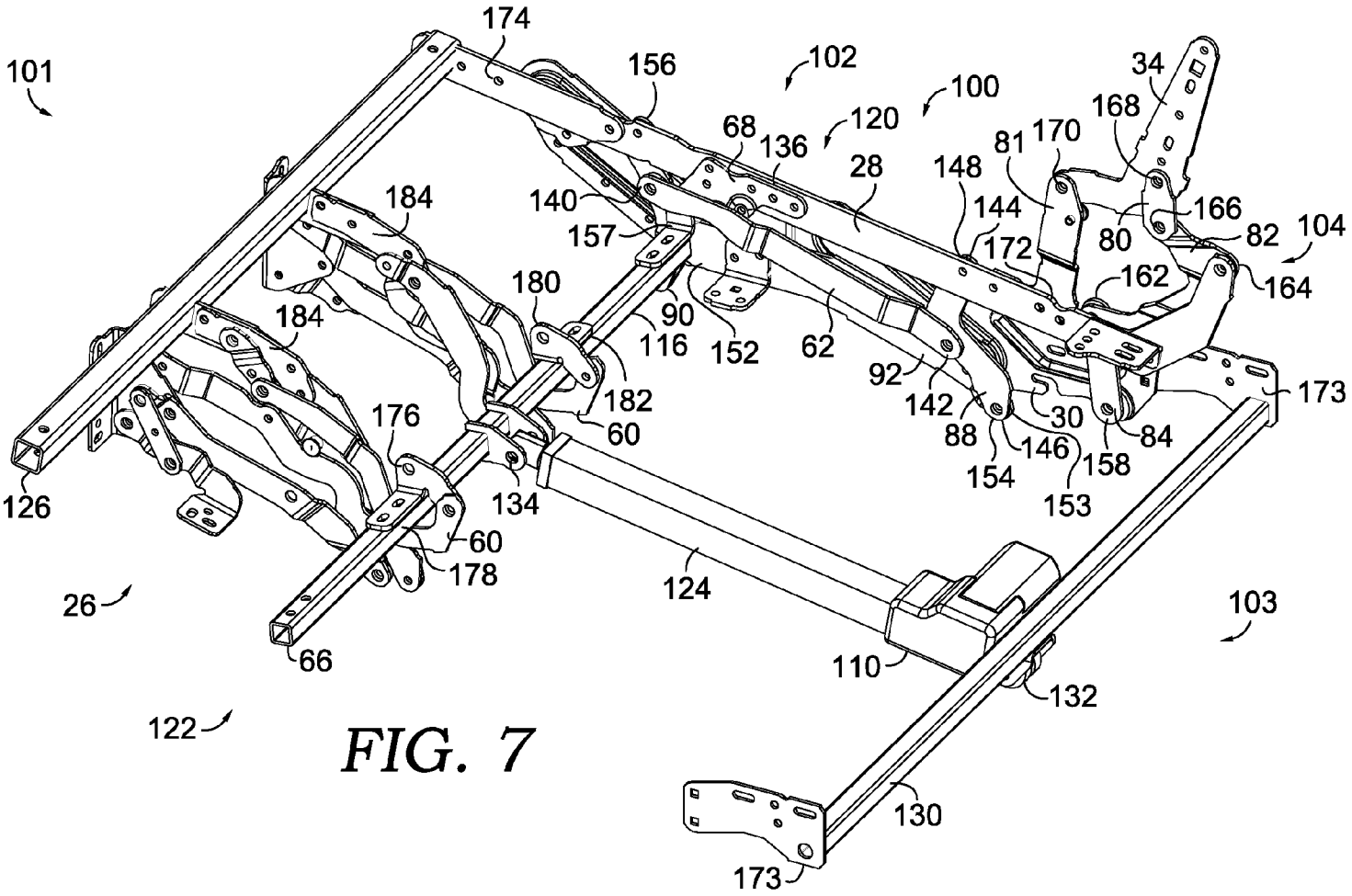
FIG. 7 depicts an angled perspective view of the motorized, adjustable linkage mechanism in FIG. 6, in accordance with an embodiment of the present invention.
Figure 8:
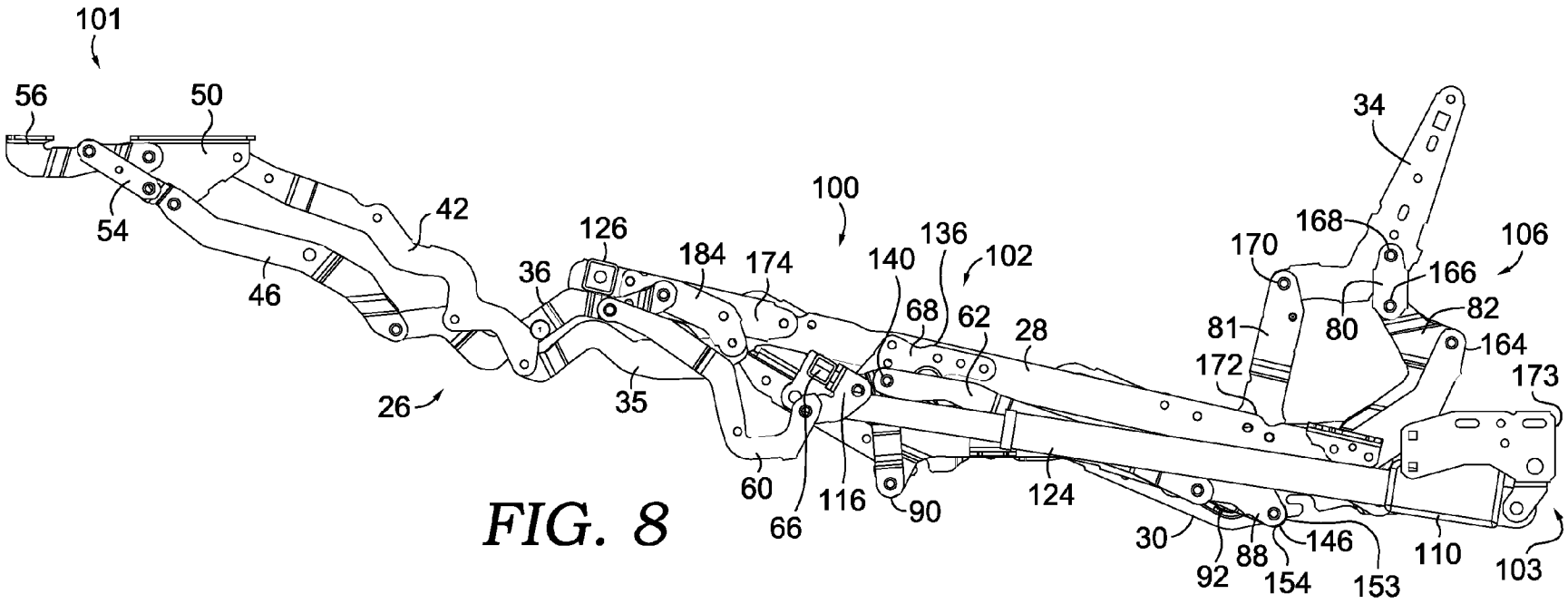
FIG. 8 depicts a side view of the motorized, adjustable linkage mechanism in FIG. 6 in an extended position, in accordance with an embodiment of the present invention.
Figure 9:
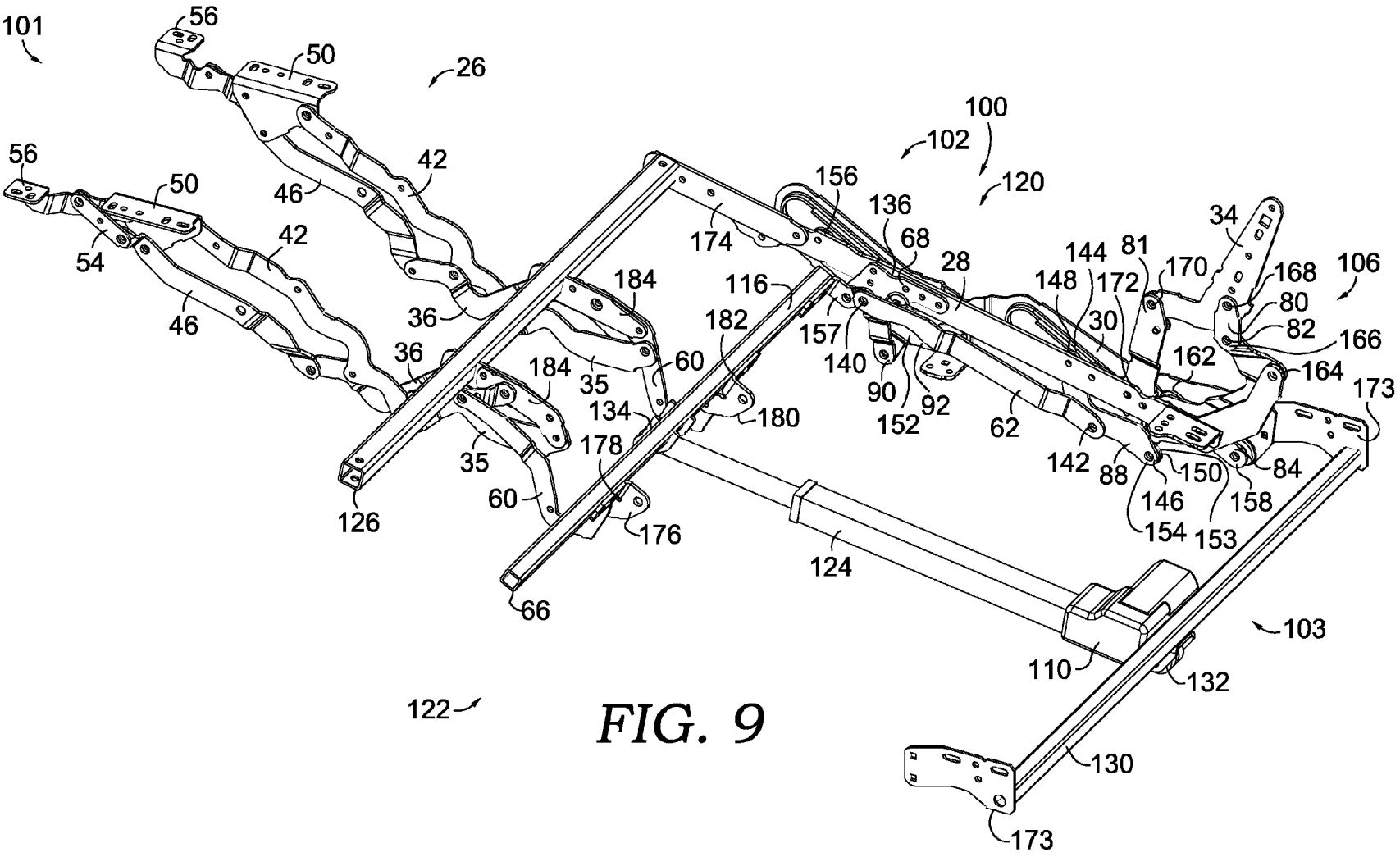
FIG. 9 depicts an angled perspective view of the motorized, adjustable linkage mechanism in FIG. 8, in accordance with an embodiment of the present invention.
Figure 10:
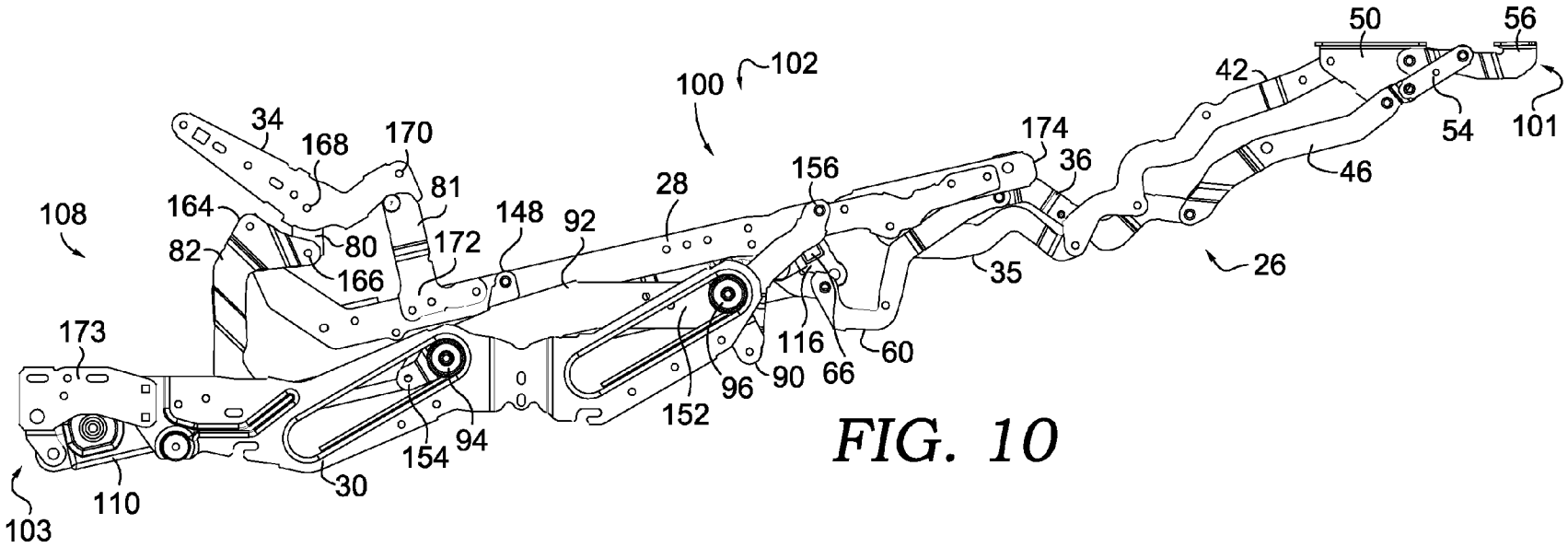
FIG. 10 depicts a side view of the motorized, adjustable linkage mechanism in FIG. 6 in a reclined position, in accordance with an embodiment of the present invention.
Figure 11:
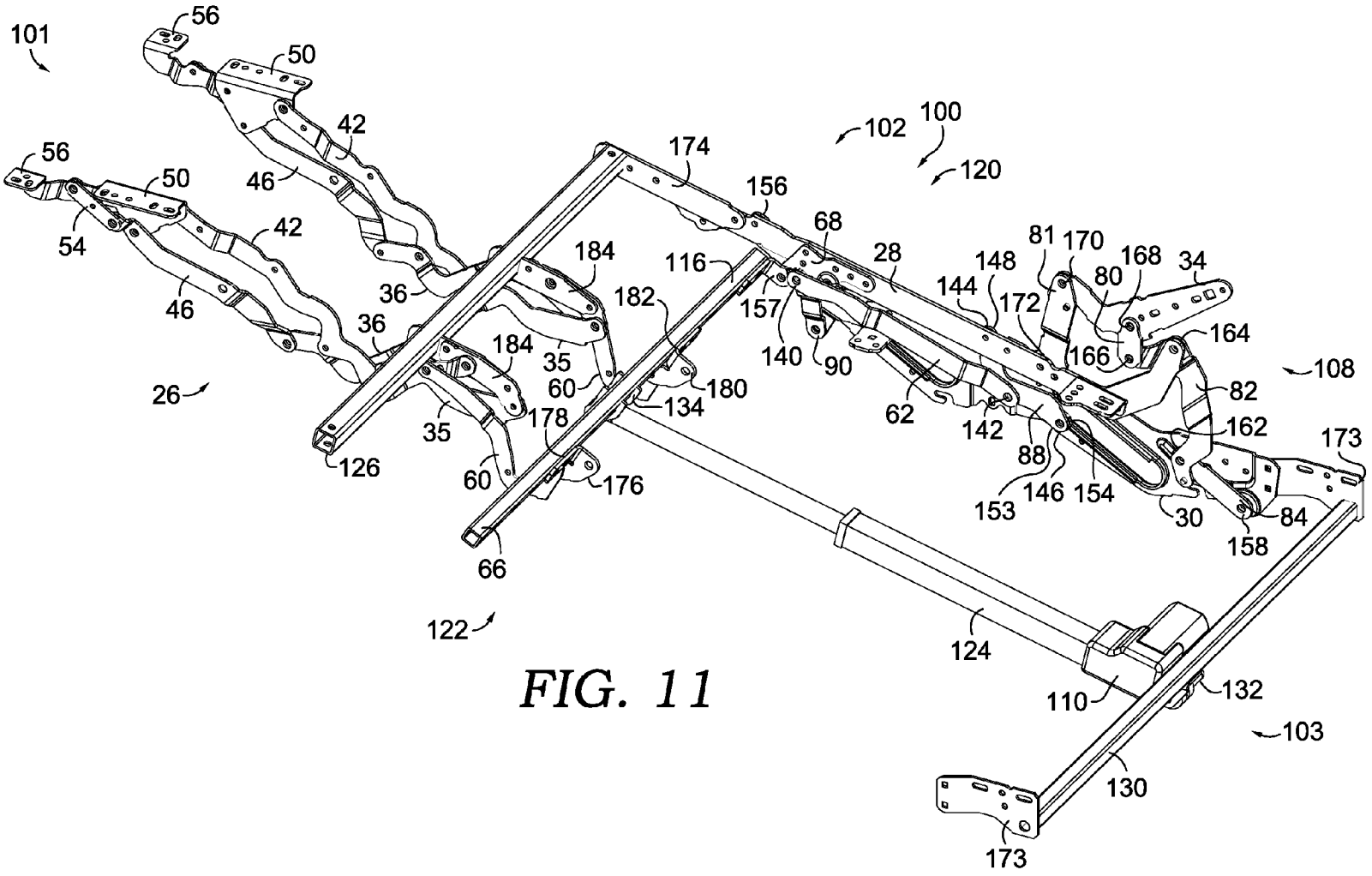
FIG. 11 depicts an angled perspective view of the motorized, adjustable linkage mechanism in FIG. 10, in accordance with an embodiment of the present invention.
Figure 12:
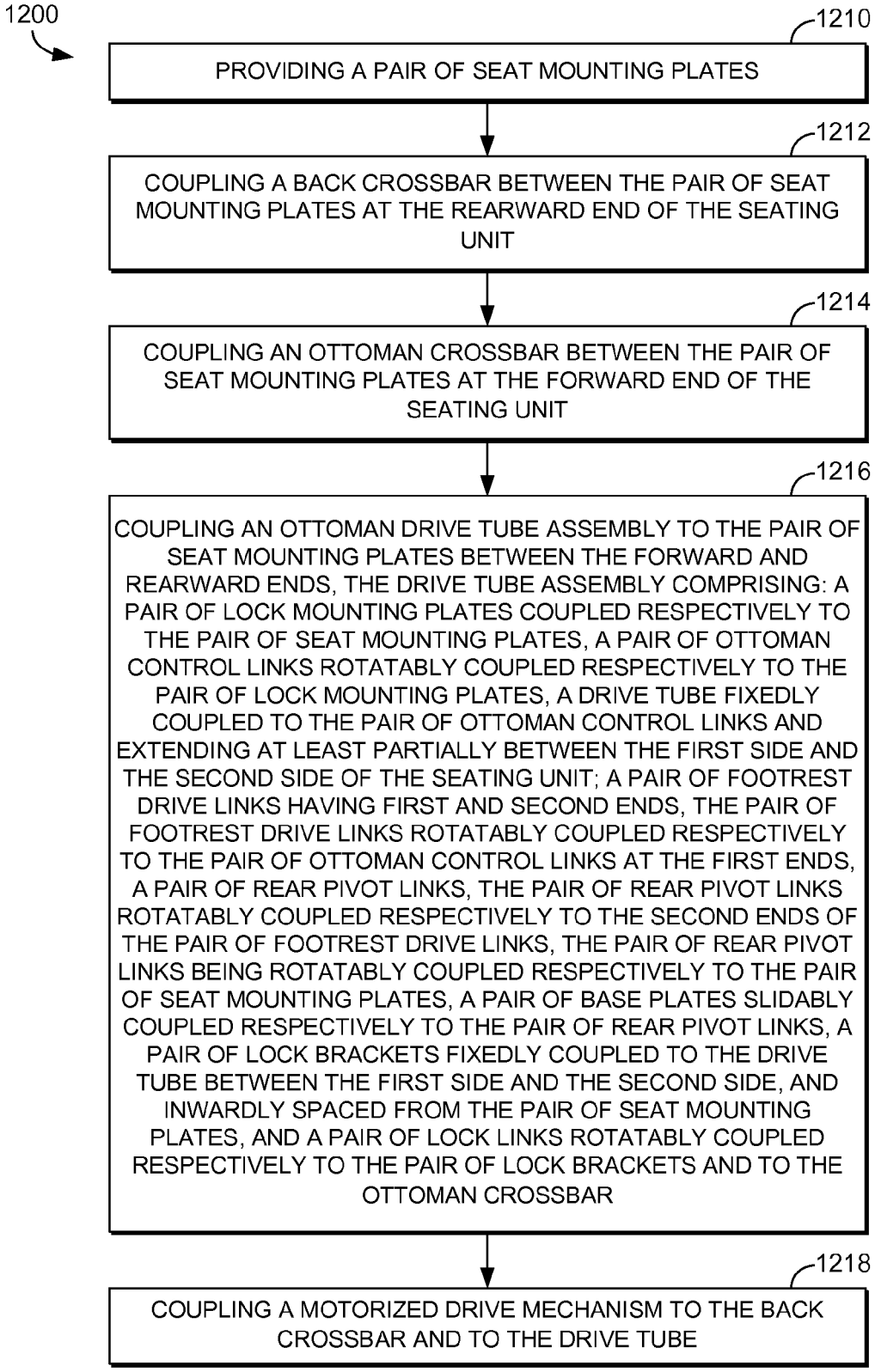
FIG. 12 depicts a block diagram of an exemplary method for assembling a motorized linkage mechanism for an adjustable seating unit, in accordance with an embodiment of the present invention.

FIG. 5 depicts various views of different combinations of linkages, which are labeled, in accordance with an embodiment of the present invention.

Many different arrangements of the various components depicted, as well as components not shown, are possible without departing from the scope of the claims below. Embodiments of our technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A linkage mechanism for a seating unit, the linkage mechanism comprising:

a seat mounting plate having a seat-mounting surface onto which a seat is mountable;

a base plate;

a roller link coupled to the seat mounting plate, and wherein the base plate is slidably coupled to the roller link;

a rear ottoman link and front ottoman link attached to the seat mounting plate;

a main ottoman link attached to the rear ottoman link and to a footrest bracket for supporting a first footrest;

a second ottoman link attached to the front ottoman link and to the footrest bracket;

a mid-ottoman bracket attached to the main ottoman link and configured to support a second footrest, the mid-ottoman bracket further attached to the second ottoman link by a mid-ottoman control link;

a flipper control link attached to the second ottoman link; and a flipper ottoman bracket attached to the flipper control link and to the footrest bracket, wherein the flipper ottoman bracket includes a footrest mounting surface for supporting a third footrest and wherein the linkage mechanism is movable between a closed position and an extended position.

2. The linkage mechanism of claim 1, further comprising: a stop along the front ottoman link positioned to prevent the linkage mechanism from moving farther than the closed position.

3. The linkage mechanism of claim 1, further comprising a lock link pivotably coupled to the front ottoman link and to a lock bracket, which is coupled to a drive tube, wherein activation of the drive tube operates the lock link, which in turn directly drives the front ottoman link.

4. The linkage mechanism of claim 1, further comprising:

a front pivot link attached to the seat mounting plate, and wherein the roller link comprises a first end and a second end, and the roller link is attached at the first end to a rear pivot link and attached at the second end to the front pivot link.

5. The linkage mechanism of claim 1, further comprising:

a rear bellcrank coupled to the seat mounting plate; and a back toggle link rotatably coupled to the base plate, and to the rear bellcrank.

6. The linkage mechanism of claim 5, wherein the roller link further comprises a first roller slidably coupled to the seat mounting plate at a first track location and a second roller slidably coupled to the base plate at a second track location.

7. A support structure for a seating unit, the support structure comprising:

a seating-unit leg;

a base plate attached to the seating-unit leg;

a seat-adjustment assembly attached to the base plate;

a seat mounting plate that is attached to the seat-adjustment assembly and that includes a seat mounting surface, wherein a distance between a bottom end of the seating-unit leg and the seat mounting surface is in a range of about 11 inches to about 12.5 inches; and a footrest assembly coupled to the seat mounting plate and movable between a closed position and an extended position using the seat-adjustment assembly, the footrest assembly including:

a rear ottoman link and a front ottoman link attached to the seat mounting plate;

a main ottoman link attached to the rear ottoman link and to a footrest bracket for supporting a first footrest;

a second ottoman link attached to the front ottoman link and to the footrest bracket;

a mid-ottoman bracket attached to the main ottoman link and configured to support a second footrest, the mid-ottoman bracket further attached to the second ottoman link by a mid-ottoman control link;

a flipper control link attached to the second ottoman link;

a flipper ottoman bracket attached to the flipper control link and to the footrest bracket, wherein the flipper ottoman bracket includes a footrest mounting surface for supporting a third footrest;

a rear pivot link attached to the seat mounting plate and a front pivot link attached to the seat mounting plate;

a roller link comprising a first end and a second end, wherein the roller link is attached at the first end to the rear pivot link and attached at the second end to the front pivot link, and wherein the base plate is slidably coupled to roller link;

a rear bellcrank coupled to the seat mounting plate; and a back toggle link rotatably coupled to the base plate, and to the rear bellcrank.

8. The support structure of claim 7, wherein activating the rear bellcrank initiates a forward motion of the seat mounting plate.

* * * * *